United States Patent [19]

Dickie

[11] Patent Number: 4,721,483

[45] Date of Patent: Jan. 26, 1988

[54] SHIELDED CONNECTOR ASSEMBLY FOR FLAT BRAIDED CABLE

[75] Inventor: Robert G. Dickie, New Market, Canada

[73] Assignee: Northern Technologies Ltd., Markham, Canada

[21] Appl. No.: 831,231

[22] Filed: Apr. 21, 1986

Related U.S. Application Data

[63] Continuation-in-part of Ser. No. 580,521, Feb. 15, 1984, which is a continuation-in-part of Ser. No. 489,314, Apr. 28, 1984, abandoned.

[51] Int. Cl.[4] ..... H01R 13/643

[52] U.S. Cl. ..... 439/610; 439/497; 439/465

[58] Field of Search ..... 339/14 R, 143 R, 17 F, 339/176 MF, 107, 136, 138, 141, 139; 174/117 F, 117 FF; 439/497, 499, 609, 610, 460, 465, 469, 494, 495, 496, 498

[56] References Cited

U.S. PATENT DOCUMENTS

| | | | |
|---|---|---|---|
| 3,634,782 | 1/1972 | Marshall | 333/1 |
| 3,663,739 | 5/1972 | Chevrier | 174/36 |
| 4,040,704 | 8/1977 | Huber | 339/99 R |
| 4,040,705 | 8/1977 | Huber | 339/99 R |
| 4,108,527 | 8/1978 | Douty et al. | 339/107 |
| 4,272,148 | 6/1981 | Knack, Jr. | 339/143 R |
| 4,444,450 | 4/1984 | Huber | 339/107 |
| 4,458,967 | 7/1984 | King et al. | 339/14 R |
| 4,534,608 | 8/1985 | Scott et al. | 339/107 X |
| 4,537,458 | 8/1985 | Worth | 339/143 R |
| 4,569,566 | 2/1986 | Triner | 339/143 R X |

*Primary Examiner*—Eugene F. Desmond

*Attorney, Agent, or Firm*—Woodcock Washburn Kurtz Mackiewicz & Norris

[57] ABSTRACT

A cover assembly for a connector for flat shielded multi-conductor cable comprising two shell halves and two compressible inserts such that the connected embodiment provides shielding integrity, strain relief and grounding for the arrangement, while neither distorting nor squashing the multi-conductor cable. This connector facilitates easy attachment, and is designed to accommodate the varying cable sizes and diameters manufactured by a variety of firms.

13 Claims, 6 Drawing Figures

SHIELDED CONNECTOR ASSEMBLY FOR FLAT BRAIDED CABLE

RELATED APPLICATIONS

This application is a continuation-in-part of application Ser. No. 580,521, Feb. 15, 1984, which is a continuation-in-part of Application Ser. No. 489,314, filed April 28, 1984, now abandoned.

BACKGROUND OF THE INVENTION

This invention relates to a connector assembly which provides strain relief and shielding for a flat shielded braided cable.

The rise of miniaturization in the electronic industry placed a large number of discrete signal-receiving devices, e.g., integrated circuit chips, in tiny areas. The diameters of the signal-carrying wires were small enough taken alone, but the number required to connect a printed circuit board having a number of these devices thereon, created a bulky package. Flat cable consisting of numerous conductors surrounded by a single dielectric sheath provided an initial answer. Flat cable allows high density wiring, offers a neat appearance, and is conducive to use with labor-saving mass termination insulation displacement connectors. The use of flat cables for interconnecting components of electrical and electronic equipment has rapidly increased.

The increased utilization of such cable however, caused a resulting problem of electromagnetic interference (EMI) which results in the unintended transfer and obstruction of electronic signals. This phenomenon forced workers in the field to seek an improved cable. An early effort to eliminate EMI resulted in a ribbon cable having a shield wrapped around, it, such as that disclosed in U.S. Pat. No. 3,634,782 Marshall. Subsequently, U.S. Pat. No. 3,663,739 Chevrier issued, which taught wrapping a shield around each wire, i.e., around the dielectric surrounding each center conductor. Cross-talk between individual conductors, as well as interference to and from the ribbon, was effectively prevented. With the proliferation of computer equipment and the increased frequencies or pulse rates employed in such equipment, the problem of controlling electromagnetic interference (EMI) has resulted in the FCC and other similar authorities imposing increasingly stringent shielding requirements.

The solving of the EMI problem, however, brought about the problem of terminating the shielding from the cable to the connector. The shields in most common usage consist of a film, such as Mylar ® with a conductive material. These kinds of shields prohibit all but the very careful stripping of the outer insulating jacket.

One feature provided by many prior art connector housings is strain relief at the point where the cable enters the connector housing. Often strain relief is provided by a complex collar and clamp mechanism attached to the housing. One disadvantage of some commonly available clamps is that they tend to squash the cable rather than clamping it uniformly about its periphery. Several prior art disclosures, such as U.S. Pat. Nos. 4,534,608, 4,458,967 William et al, 4,537,458 Worth provide strain relief in this manner U.S. Pat. No. 4,534,608 Scott et al specifically teaches strain relief through a series of ribbed ridges which deform the cable into a "serpentine" configuration.

U.S. Pat. Nos. 4,040,705, Huber and 4,040,704 Huber illustrate a second related problem with the prior art the breaking or piercing of the dielectric outer shell in order to secure clamping and strain relief.

The methods disclosed by the prior art also rely on the resiliency of the outer dielectric insulating jacket to maintain firm contact between the connector housing and cable in order to facilitate strain relief. With age, the plastic material of the outer dielectric shell loses its resiliency and takes a permanent set. Inadequate tightening results in poor electrical contact and strain relief, while excessive tightening of the blocks beyond the elastic limits of the jacket material and the outer insulation could result in short-circuiting of the conductors.

A final problem with the prior art connectors, is that they were designed to accommodate only one specific cable or line of products.

The present invention successfully solves the problems associated with these prior art connectors. In accordance with the invention, a connector firmly and uniformly connects a flat shielded braided cable, simultaneously providing electromagnetic shielding and strain relief for a variety of cable sizes and diameters. It eliminates the need of breaking the outer dielectric shell, and solves the problems of poor contact due to lack of resiliency. Finally, it provides strain relief without squashing or in any way impairing the multi-conductor cable or the shielding.

SUMMARY OF THE INVENTION

This invention provides a connector cover assembly consisting of two connectable shell halves for a shielded, flat braided cable. Each connectable shell half has a flat passage facing outward through which the flat braided cable passe and a front passage and opening adapted to receive a multi-pin connector. The connectable shell halves are so disposed that when mated, they form a groove for securing the multi-pin connector. The invention also provides two compressible inserts each having a flat inner surface which lies adjacent to the cable, and a substantially flat or ribbed outer surface which lies adjacent to and matches the contour of the inside wall of the each connectable shell half.

The inside walls of the shell halves of the connector cover assembly contain grooved ridges adapted to receive and mate with the substantially flat or ribbed outer surface of the inserts. When the shells are mated, and the assembly is enclosed, the inserts are disposed in the respective grooves such that the inner surface of each insert clamps the cable uniformly around the inner surface of the insert, thereby maintaining shielding integrity. A sliced section of outer dielectric coating and braided shield is wrapped around the outer ribbed surface of each insert and sandwiched between said ribbed outer surface of each insert and the matching inside wall of each respective shell half, which is composed of grooved ridges, thereby simultaneously grounding the braided shield and providing strain relief. This connector cover assembly accommodates a variety of cable diameters while maintaining shielding integrity, adequate grounding and strain relief.

DETAILED DESCRIPTION OF THE PREFERRED EMBODIMENT

A preferred embodiment of a shielded connector assembly for flat braid cable is references with references to the accompanying six FIGS. 1 through 6 wherein the same numbers are used.

Figure 1:
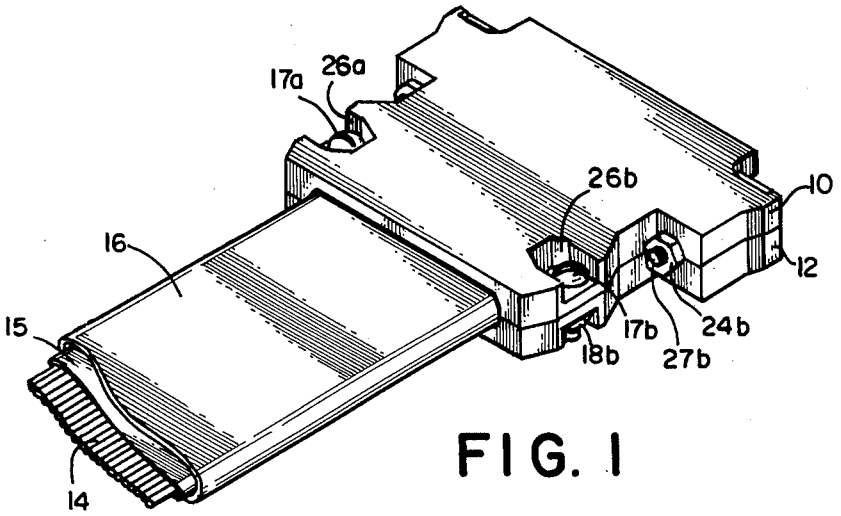
FIG. 1 is rear perspective view of the assembled preferred connector embodiment which illustrates the flat shielded braided cable entering the claimed connector.
Figure 2:
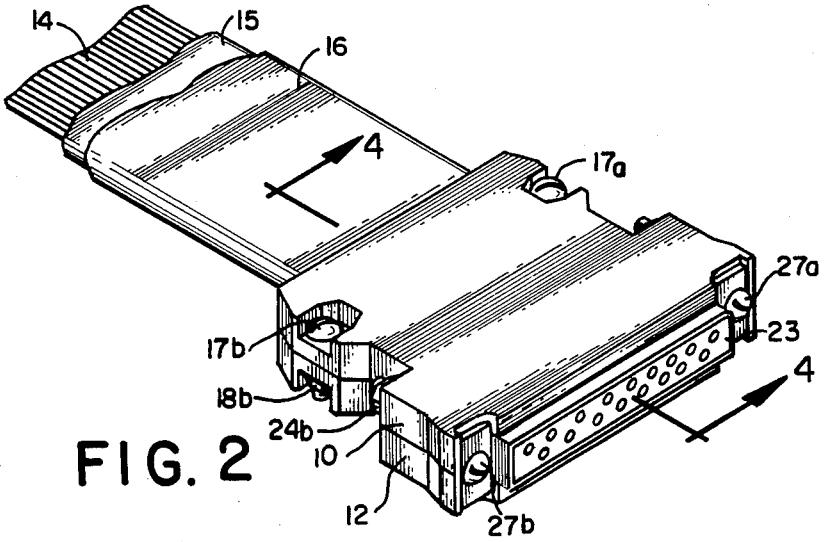
FIG. 2 is frontal perspective view of the assembled preferred connector embodiment.

Referring to FIGS. 1 and 2, shielded flat braided cable 13 consisting of braided multiconductor cable 14, shielding sheath 15 generally consisting of a substance such as Mylar, and surrounding dielectric coating 16 which encloses the braided multiconductor cable and shielding sheath is shown. The connector cover assembly of the preferred embodiment consisting of a first shell half 10 and a mating second shell half 12 is also illustrated.

Figure 3:
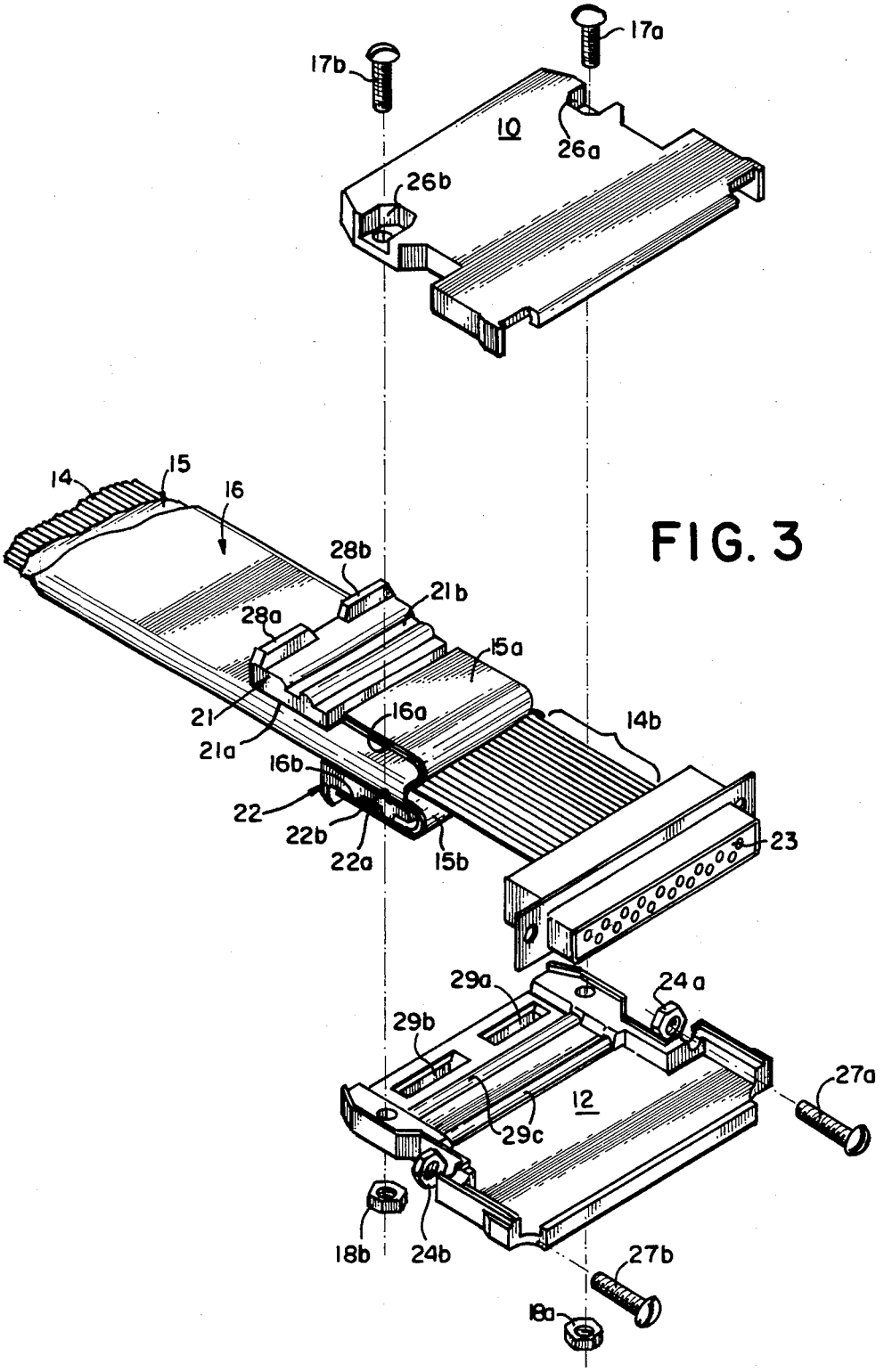
FIG. 3 is an exploded view of the preferred connector embodiment.

Referring to FIGS. 1 and 3, shell halves 10 and 12 when mated, are attached with screws 17, 17*a* and nuts 18, 18*a*. The shell halves 10, 12 contain prebored holes 26 and 26*a* which accommodate screws 17 and 17*a*, the holes being set below the plane of the connector shell halves. Holes 26 and 26*a* are set off in such a manner as to permit the unobstructed passage of the cable through the connector.

Figure 4:
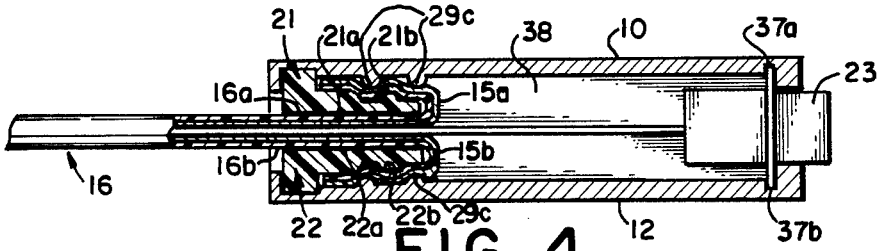
FIG. 4 is a cross-sectional side view of the assembled preferred connector embodiment.
Figure 5:
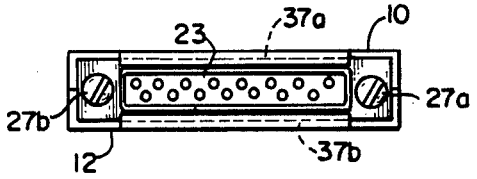
FIG. 5 provides a front view of the assembled preferred connector embodiment.
Figure 6:
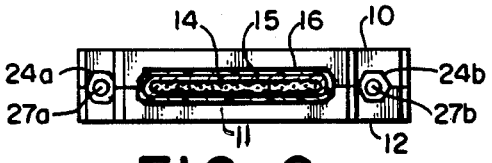
FIG. 6 provides a rear view of the assembled preferred connector embodiment.

Referring to FIGS. 2, 5, and 6, when mated, connector shell halves 10 and 12 form an opening in which multi-pin connector 23 is attached to the connector housing with screws 27*b*, 27*a*, and nuts 24*b*, 24*a*. As an alternative, attachment of the multi-pin connector may be facilitated with captive screws held by ridges located within the connector shell halves 10 and 12. Referring to FIG. 3, when mated, the connector shell halves 10 and 12 form holes 25 and 25*a* to accept screws 27*b*, 27*a* and nuts 24*b*, 24*a*, thereby facilitating attachment of multi-pin connector 23. Referring to FIG. 4, each shell half 10 and 12 has a groove 37*a* and 37*b* which, when mated, is so disposed to firmly hold the multi-pin connector about its outer ridge. Shell halves 10 and 12 also form a flat passage 11 when mated, through which the cable 13 extends.

Referring to FIG. 3, a section of dielectric coating 16 and Mylar® shielding 15 is sliced along both narrow sides of cable 13 using a razor or utility knife. The resulting sliced dielectric coating halves 16*a* and 16*b* and shielding halves 15*a* and 15*b* are then folded back simultaneously on both sides of the braided cable 14 leaving a narrow sheath of exposed braided cable 14*b*. Shielding halves 15*a* and 15*b* are easily peeled back by hand on both sides. Multi-pin connector 23 is then attached to the exposed end of braided cable 14*b*.

Referring to FIGS. 3 and 4, soft inserts 21 and 22 consisting of a rubber like material such as polyvinylchloride with a resilience of between 60–80 durometers are emplaced such that the flat surface 21*a* and 22*a* of said inserts lie adjacent to the outer non-sliced dielectric coating 16 of the cable. Sliced dielectric coating halves 16*a* and 16*b* and sliced shielding halves 15*a* and 15*b* are then folded back over the ribbed outer surface 21*b* and 22*b* of each insert 21 and 22, thereby completely blanketing said ribbed outer surface of each insert except for two protrusions 28*b* and 28*a* located on each. The exposed protrusions 28 and 28*a*, when mated with each shell half 10, 12, fit into grooves 29*a* and 29*b* located on the interior of each shell half. In the preferred embodiment, the inner surfaces of shell halves 10 and 12 have gripping ridges 29*c* which, when connected, are designed to mate with the contour of the ribbed outer surfaces 21*b*, 22*b* of the soft inserts 21 and 22.

Referring to FIG. 4, when connected, sliced dielectric coating halves 16*b* and 16*a* and sliced shielding halves 15*a* and 15*b* are sandwiched between gripping ridges 29*c* and ribbed outer surfaces 21*b* and 22*b*, respectively. This arrangement simultaneously provides grounding of the shielding sheath 15*a* and 15*b* and strain relief for the preferred embodiment. In the preferred embodiment, each shell half is made of a material such as metal which provides a ground connection for the cable braid. The strain relief is concentrated on the sandwiched sliced dielectric coatings 16*b* and 16*a*. Further, when mated, the flat inner surface of each insert 21*a* and 22*a*, remains flush against the unsliced dielectric coating 16. This feature maintains the seal of the flat passage 11, thereby maintaining the shielding integrity of the arrangement. The mated connector contains substantial internal free space 38, thereby accommodating a wide range of cable diameters.

While a particular embodiment of the invention has been shown and described, various modifications are within the true spirit and scope of the invention. The appended claims are, therefore, intended to cover all such modifications.

What is claimed is:

1. A cover assembly for a connector and the end of a flat cable having a dielectric coating encasing shield braid and inner conductors, said connector being connected to said cover assembly comprising:

a first sheel half and a mating second shell half forming together, when mated, an enclosure having a front side wall, and at least one other side wall;

a front opening in said front side wall in which said connector is attached so that the front face of side connector faces outwardly of said cover assembly;

a flat passage extending away from an opening in said other side wall through which said cable extends outwardly of said cover assembly, ssaid flat passasge being formed by said first and second half shells when mated;

at least two flat compressible inserts each having a flat inner surface and a substantially flat coextensive outer surface;

said inserts being disposed in said flat passage such that the inner surface of each insert contacts said cable adjacent said other side wall when said assembly is closed to uniformly clamp said cable about the inner flat surfaces of said inserts to maintain shielding integrity;

a sliced section of dielectric outer coating and shielded braid being compressed between the outer surfaces of said inserts and said enclosure when said shell halves are mated thereby providing electrical grounding between said shell halves and said shielding braid; and said shell halves providing a substantial hollow interior region within said cover assembly, thereby enabling a single cover assembly to accommodate a variable number of cable sizes, while simultaneously maintaining shielding integrity, strain relief and grounding.

2. The assembly recited in claim 1 further comprising:
at least one gripping rib on the coextensive outer surface of each insert.

3. The assembly recited in claim 2 wherein there is at least one protrusion extending from the outer surface of each insert.

4. The assembly recited in claim 2 wherein each of said inserts has a ribbed outer surface.

5. The assembly recited in claim 4 further comprising:
gripping ridges on the inner surfaces of said shells in said passage.

6. The assembly recited in claim 5 wherein said gripping ridges mate with said ribbed outer surfaces of said inserts.

7. The assembly recited in claim 5 wherein said insert is a polyvinylchloride material.

8. The assembly recited in claim 1 wherein said insert is a rubber-like material.

9. The assembly recited in claim 1 wherein said insert has a resilience with a durometer between 60 and 80.

10. A cover assembly for a multi-pin connector for flat multiconductor cable consisting of a dielectric coating enclosing a shielded braid and inner conductors, said cover assembly comprising:

a first metallic shell half and a second mating metallic shell half which, when mated in a clamped position, form an opening in the front side wall and an opening in the rear side wall;

said opening in the front side wall being adapted to receive said multi-pin connector so that the front face of the multipin connector faces outward of the cover assembly;

said first half shell and said second mating half shell, when clamped together in a mated position, forming a groove which encloses and secures an outer rim of said multipin connector;

two (2) soft compressible inserts each having a flat inner surface and a ribbed coexteisive outer surface with two protrusions;

the interiors of said first and second half shells having gripping ridges which mate with the ribbed outer surface and two protrusions of said compressible soft inserts;

said inserts being mated with said gripping ridges such that the inner surface of said insert contacts said cable when said assembly is closed to uniformly clamp said cable one the inner surface of said inserts to maintain shielding integrity;

a sliced section of dielectric outer coating and shielded braid being compressed between the outer surfaces of said inserts and said shell when said shell halves are mated thereby providing electric grounding between said shell halves and said shielded braid; and said first half shell and a mating second half shell which when compressed together in a closed position with said soft inserts, provide a cover assembly containing substantial free interior space thereby enabling a single cover size to accommodate a variable number of cable sizes while maintaining shielding integrity and grounding.

11. The assembly recited in claim 10 wherein said insert is a rubber-like material.

12. The assembly recited in claim 10 wherein said insert has a resilience with a durometer between 60 and 80.

13. The assembly recited in claim 10 wherein said insert is a polyvinylchloride material.

* * * * *

UNITED STATES PATENT AND TRADEMARK OFFICE

CERTIFICATE OF CORRECTION

PATENT NO. : 4,721,483

DATED : January 26, 1988

INVENTOR(S) : Robert G. Dickie

It is certified that error appears in the above-identified patent and that said Letters Patent is hereby corrected as shown below:

IN THE SPECIFICATION:

Column 1, line 51, after "Mylar®" insert --coated--.

Column 1, line 63, after "manner", insert --.--.

Column 3, line 12, delete "references" and substitute therefor --described--.

Column 3, line 45, after "nector" insert --23--.

IN THE CLAIMS:

Column 4, line 37, delete "sheel" and substitute therefor --shell--.

Column 4, line 45, delete "ssaid" and substitute therefor --said--.

Signed and Sealed this

Ninth Day of August, 1988

*Attest:*

*Attesting Officer*

DONALD J. QUIGG

*Commissioner of Patents and Trademarks*